United States Patent [19]

Arnoldy et al.

[11] Patent Number: 4,904,342

[45] Date of Patent: Feb. 27, 1990

[54] PROCESS FOR PULPING LIGNOCELLULOSE-CONTAINING MATERIAL

[75] Inventors: Peter Arnoldy; Leonardus Petrus, both of Amsterdam, Netherlands

[73] Assignee: Shell Oil Company, Houston, Tex.

[21] Appl. No.: 243,004

[22] Filed: Sep. 12, 1988

[30] Foreign Application Priority Data

Sep. 14, 1987 [GB] United Kingdom ..... 8721528

[51] Int. Cl.[4] ..... D21C 3/20

[52] U.S. Cl. ..... 162/76; 162/77

[58] Field of Search ..... 162/76, 77, 72

[56] References Cited

FOREIGN PATENT DOCUMENTS 34784 4/1985 Hungary .

82/01902 6/1982 PCT Int'l Appl. .

*Primary Examiner*—Peter Chin

[57] ABSTRACT

A process for the pulping of lignocellulose-containing material, wherein the material is contacted with a pulping medium containing at least 75% by weight of a solvent system, which solvent system comprises from 20 to 95% by weight formic acid; from 5 to 80% by weight of at least one member selected from primary alcohols having from 1 to 3 carbon atoms and esters of formic acid with primary alcohols having from 1 to 3 carbon atoms; and up to 70% by weight of at least one component selected from acetic acid and esters of acetic acid with primary alcohols having from 1 to 3 carbon atoms; and allowing the material to digest at a temperature in ther range of from 140° to 200° C.

6 Claims, No Drawings

PROCESS FOR PULPING LIGNOCELLULOSE-CONTAINING MATERIAL

The present invention relates to a process for pulping lignocellulose-containing material in which the material is contacted with a pulping medium containing formic acid and one or more defined co-solvent(s).

Lignocellulose-containing material, for example wood, comprises cellulose, hemicellulose and lignin. Cellulose comprises a high molecular weight linear polymer of D-glucose; hemicellulose comprises a lower molecular weight branched polymer of hexoses and pentoses; and lignin comprises a lower molecular weight polypropylphenyl ether.

Cellulose may be extracted, in the form of pulp, from lignocellulose-containing material by a process known as pulping; i.e. by digestion using a pulping medium. The two conventional lignocellulose pulping processes are the kraft and sulfite processes. In both of these processes the pulping medium is an aqueous solution of inorganic salts. These salts are recovered by burning the liberated lignin and hemicellulose. This is disadvantageous since the lignin and hemicellulose are wasted, and atmospheric pollution may result.

In recent times, a considerable amount of effort has been devoted to finding new processes for pulping lignocellulose-containing material in which the lignin and hemicellulose is not wasted, and which do not cause atmospheric pollution. Attention has concentrated on the use of organic solvents. One new process, in which the organic solvent is formic acid, is described in International patent application number WO 82/01902 (Jordan). This patent specification discloses a process for pulping wood or bark comprising combining wood or bark with formic acid of at least 35% concentration and then separating the pulp from the liquor.

It is stated in the specification at page 2, lines 30 to 32, that softwoods are more difficult to pulp than hardwoods using the process. Only the pulping of a hardwood is exemplified. Since most paper is in fact made from pulp derived from softwoods, the relatively poor performance of the process when applied to softwoods is disadvantageous.

We have found that when small chips of the softwood *Pinus radiata* are treated with 83% by weight aqueous formic acid, the pulping medium of the type described in WO 82/01902, at 150° C. for 1 hour, then a pulp of only poor quality is obtained.

Surprisingly we have now found that lignocellulose-containing material may advantageously be pulped using a pulping medium containing formic acid and one or more defined alcohols and/or alkyl formates.

Accordingly, the present invention provides a process for the pulping of lignocellulose-containing material, wherein the material is contacted with a pulping medium containing at least 75% by weight of a solvent system, which solvent system comprises from 20 to 95% by weight formic acid; from 5 to 80% by weight of at least one member selected from primary alcohols having from 1 to 3 carbon atoms and esters of formic acid with primary alcohols having from 1 to 3 carbon atoms; and optionally up to 70% by weight of at least one component selected from acetic acid and esters of acetic acid with primary alcohols having from 1 to 3 carbon atoms; and allowing the material to digest at a temperature in the range of from 140° to 200° C.

In the process according to the invention, the pulping medium preferably contains up to 90% by weight of the solvent system. When present, the diluent is preferably water. Optionally, a surfactant may also be included in the diluent.

Preferably the at least one member is selected from methanol and ethanol. Preferably the at least one component is acetic acid.

The preferred compositions of the solvent system depend, to some extent, upon the temperature. Thus when the digestion temperature is in the range of from 175° to 200° C., the solvent system preferably contains from 25 to 50% by weight formic acid and up to 10% by weight acetic acid; when the temperature is in the range of from 160° to 175° C., the solvent system preferably contains from 50 to 70% by weight formic acid; and when the temperature is in the range of from 140° to 160° C., it preferably contains from 70 to 95% by weight formic acid.

In a preferred embodiment, the pulping medium contains at least 90% by weight of the solvent system, which solvent system comprises from 30 to 45% by weight formic acid; from 5 to 15% by weight of at least one member selected from methanol and ethanol; and from 40 to 60% by weight acetic acid; and the material is allowed to digest at a temperature in the range of from 150° to 190° C.

The lignocellulose-containing material may, for example, be wood, including hardwood, softwood and bark; straw; bagasse; lignin-containing biomass; agricultural residues; grass or bamboo.

The lignocellulose-containing material may conveniently be contacted with the pulping medium in divided form. For example, wood may be contacted with the pulping medium in the form of woodchips or sawdust. The upper limit of the weight ratio of pulping medium to lignocellulose-containing material is not critical, but will depend upon economic factors. Generally the weight ratio will be above 3, preferably above 4, and not more than 15.

In the process according to the invention, the digestion step must normally be effected at elevated pressure so that the pulping medium remains liquid. The pressure is not critical, but will conveniently be in the range of from 4 to 100 bar, for example from 4 to 55 bar. The process may be effected continuously or batchwise.

The digestion product of the process according to the invention comprises a mixture of pulp and digest liquor. These materials may be separated, for example by filtration. According to another aspect of the invention, therefore, there are provided pulp and digest liquor whenever prepared by a process as described hereinabove.

Pulp has a wide variety of applications, the most important of which are in the production of paper and dissolving pulp. Two parameters which are conventionally used to describe the quality of pulp for paper making are the intrinsic viscosity and the Kappa number. The quality of pulp prepared by the process according to the present invention, as measured by these parameters, is surprisingly high.

The digest liquor obtained by the process of the invention contains useful chemical compounds including lignin and compounds derived from the hemicellulose present in the lignocellulose-containing material. These compounds may be separated from one another using conventional techniques. As described by W. G. Glasser in Forest Products Journal, 31, 24 to 29 (1981), lignin has a wide range of alternative uses, for example in the preparation of benzene, substituted benzenes, phenol and substituted phenols. The compounds derived from hemicellulose, which are mainly sugars, may readily be converted into such useful products as furfural, hydroxymethylfurfural and levulinic acid, for example as described by H. H. Nimz in a paper presented in Paris at the Fourth International Symposium on Wood and Pulping Chemistry, April, 27-30, 1987.

The invention will now be illustrated in more detail by the following Examples. Examples 1 to 12 illustrate the process according to the invention while Example 13 is a comparative Example, using a pulping medium containing 83% by weight formic acid, a medium of the type described in WO 82/01902

EXAMPLES 1 TO 13

Pulping media containing a defined % by weight of a defined solvent system were passed, at a rate of 2 $cm^3$/minute, across 3.3 g oven-dry chips (having a length of 1.0 to 2.0 mm) of the softwood *Pinus radiata,* in a stainless steel pipe of 1.2 cm diameter, for 1 hour at a constant defined temperature and a pressure of 50 atmospheres. The remaining pulp was then recovered, and its intrinsic viscosity and Kappa number were determined according to the procedures laid down for the respective American National Standards, namely ASTM D 1795-62 (reapproved 1979) and ANSI/-TAPPI T 236 os-76 (approved 1976). The results are given in Table 1 below.

TABLE 1

| Example | Solvent composition (Component; (% by wt)) | | Solvent concentration (% by wt) | Diluent (Component; concentration in % by wt) | Temp (°C.) | Viscosity (dL/g) | Kappa number |
|---|---|---|---|---|---|---|---|
| 1 | formic acid | (89) | 96 | water (4) | 150 | 8.4 | 28 |
| | methanol | (11) | | | | | |
| 2 | formic acid | (76) | 100 | — | 170 | 6.6 | 20 |
| | methanol | (24) | | | | | |
| 3 | formic acid | (73) | 95 | water (5) | 170 | 6.4 | 20 |
| | methanol | (27) | | | | | |
| 4 | formic acid | (81) | 95 | water (5) | 170 | 5.0 | 13 |
| | methanol | (19) | | | | | |
| 5 | formic acid | (78) | 89 | water (11) | 150 | 9.1 | 31 |
| | methyl formate | (22) | | | | | |
| *6 | formic acid | (39) | 90 | water (10) | 180 | 6.6 | 36 |
| | ethanol | (61) | | | | | |
| 7 | formic acid | (25) | 80 | water (20) | 180 | 6.4 | 33 |
| | ethanol | (75) | | | | | |
| 8 | formic acid | (85) | 96 | water (4) | 150 | 9.4 | 30 |
| | ethanol | (15) | | | | | |
| 9 | formic acid | (74) | 90 | water (10) | 150 | 7.8 | 29 |
| | ethyl formate | (26) | | | | | |
| *10 | formic acid | (39) | 96 | water (4) | 180 | 7.7 | 12 |
| | acetic acid | (50) | | | | | |
| | ethanol | (11) | | | | | |
| 11 | formic acid | (39) | 96 | water (4) | 170 | 10.0 | 18 |
| | acetic acid | (50) | | | | | |
| | ethanol | (11) | | | | | |
| 12 | formic acid | (39) | 96 | water (4) | 160 | 9.0 | 40 |
| | acetic acid | (50) | | | | | |
| | ethanol | (11) | | | | | |
| *13 | formic acid | (100) | 83 | water (17) | 150 | 5.0 | 55 |

*comparative example

We claim:

1. A process for the pulping of softwood lignocellulose-containing material, wherein the material is contacted with a pulping medium containing at least 90 by weight of a solvent system, which solvent system comprises (a) from 30 to 45% by weight formic acid; (b) from 5 to 15% by weight of methanol or ethanol; and (c) from 40 to 70% by weight of acetic acid; and digesting the material at a temperature in the range of from 160° to 190° C.

2. A process as claimed in claim 1, which further comprises the separation of the digestion product into pulp and digest liquor.

3. Pulp, whenever prepared by a process as claimed in claim 2.

4. Paper, whenever prepared from pulp as claimed in claim 3.

5. Digest liquor, whenever prepared by a process as claimed in claim 2.

6. A process according to claim 1 wherein (b) is ethanol.

* * * * *